US005504967A

United States Patent [19]

Graham

[11] Patent Number: 5,504,967

[45] Date of Patent: Apr. 9, 1996

[54] VACUUM OPERATED CLEANING APPARATUS

[75] Inventor: Bernard J. Graham, 214 Maplewood Drive, North Bay, Ontario, Canada, P1B 9B8

[73] Assignee: Bernard J. Graham, North Bay, Ontario, Canada

[21] Appl. No.: 205,876

[22] Filed: Mar. 3, 1994

[51] Int. Cl.[6] ..... A47L 5/38

[52] U.S. Cl. ..... 15/301; 15/314; 15/412

[58] Field of Search ..... 15/301, 314, 412

[56] References Cited

U.S. PATENT DOCUMENTS

| | | | |
|---|---|---|---|
| 2,675,273 | 4/1954 | Sanders . | |
| 2,810,028 | 10/1957 | Hopper . | |
| 2,979,755 | 4/1961 | McCaskill | 15/301 |
| 2,984,856 | 5/1961 | Hunt et al. . | |
| 3,027,587 | 4/1962 | Bierstock . | |
| 3,027,588 | 4/1962 | Bierstock . | |
| 3,655,927 | 4/1972 | Samuelson | 15/314 |
| 3,994,528 | 11/1976 | Humphrey . | |
| 4,336,427 | 6/1982 | Lindsay . | |
| 5,111,841 | 5/1992 | Houston . | |
| 5,205,013 | 4/1993 | Lopes . | |
| 5,279,016 | 1/1994 | Klassen . | |
| 5,408,721 | 4/1995 | Wall . | |

FOREIGN PATENT DOCUMENTS

| | | | |
|---|---|---|---|
| 670879 | 9/1963 | Canada . | |
| 675552 | 12/1963 | Canada . | |
| 0165908 | 12/1985 | European Pat. Off. | 15/301 |
| 2805406 | 8/1979 | Germany . | |
| 02147039 | 6/1990 | Japan . | |
| 934240 | 8/1963 | United Kingdom . | |
| 2101472 | 1/1983 | United Kingdom . | |

*Primary Examiner*—David Scherbel
*Assistant Examiner*—Randall E. Chin
*Attorney, Agent, or Firm*—Baker & Daniels

[57] ABSTRACT

A combined inlet structure and switching device for a central vacuum system includes an inlet housing having top, bottom and side walls defining a vacuum inlet chamber and a front with a dirt receiving opening. An aperture is located in the top wall and can be connected to a pipe leading to a central vacuum source. A closure member is movable between first and second positions in order to close or open the aperture. A foot operated actuator is connected to the housing and is able to pivot the closure member between the first and second positions. A spring biases the closure member towards the first position and operates when the actuator is pressed in one direction. When the closure member is moved to the second position, it will remain there unless the actuator is pressed in another, opposite direction. There is also a switch mechanism responsive to movement of the actuator for opening and closing an electrical circuit connected to the central vacuum source.

19 Claims, 4 Drawing Sheets

VACUUM OPERATED CLEANING APPARATUS

BACKGROUND OF THE INVENTION

This invention relates to air inlets for a central vacuum system within a building.

Central vacuum systems are quite common now in homes and other buildings requiring regular vacuum cleaning. Because it is not necessary to move around a rather heavy vacuum cleaning unit, they are rather convenient to use. It is simply necessary to hook up a long cleaning hose to an inlet structure mounted in a convenient wall. This inlet structure is connected by a hidden pipe system to the central vacuum source. Another advantage of such a system is that the system can provide a fairly high level of vacuum because a large vacuum creating fan can be employed at the fixed vacuum source.

In the commonly used central vacuum system, there is a standard wall mounted opening to which one end of the hose can be readily attached. Often there is a flap that can be used to close the opening and thereby prevent air entry when the air inlet is not in use. Also, the end of the hose attached to the opening may actuate a switch by joining two electrical terminals and thereby closing an electrical circuit that is connected to the central vacuum source.

One difficulty with this known, commonly used central vacuum system is that in order to clean up even a small spill or mess, it is necessary to take out and hook up a rather large, long hose and this can be inconvenient. Areas such as kitchens and dining rooms often require frequent cleaning because of the food preparation and eating that is carried on in these rooms. Also, because of the activities in these rooms, the floors are often not carpeted but have a hard, smooth surface. In such areas, rather than taking the trouble to hook up the long hose of the central vacuum system, a person may choose to use instead a dust pan and a broom or brush but these also can be inconvenient and time consuming to use.

Recent U.S. Pat. No. 5,279,016 dated Jan. 18, 1994 and issued to T. J. Klassen, describes a suction inlet for a central vacuum system that can be used without the need for hooking up a long hose to the inlet. In one version of this device a rectangular, box-like housing is mounted in or behind a baseboard or kick plate and it has an elongate, horizontally extending slot in its front, which slot is covered when the inlet device is not in use. An elongate, pivoting lever, one end of which projects from the front of the housing is connected by means of a vertical pin to a flat, rubber plug which extends over an aperture in a bottom plate. This aperture is connected to a hose or pipe that leads to the central vacuum source. By pressing with one's foot on the end of the lever, one is able to open the aperture and at the same time close an electrical circuit and thereby cause the central vacuum source to operate.

There are several difficulties that can arise with the use of the inlet structure of the aforementioned U.S. patent. The first is that in order for the inlet structure to operate in a cleaning situation, not only must one press on the actuating lever but one must continue to hold one's foot on this lever in order to keep the aperture open and the central vacuum source on. In addition, because of the nature of the housing and its box-like structure, there are likely to be "dead" zones in the housing where dirt and debris will be trapped and will not be drawn into the vacuum hose or pipe. It could be quite difficult to clean the interior of this known housing using other cleaning methods. The vertical pin and the rubber plug will create an obstruction in the chamber. Dirt and debris will get caught on these members causing blockages especially long debris such as string, hair and cloth, etc. If blockage occurs, the plug will not create a seal and power will be reduced substantially to all outlets in the system. This blockage could occur without the user knowing.

Another difficulty arises from the fact that this known system requires a hole to be cut in the floor of the building to permit the vacuum cleaning pipe to be connected from below. It may, in fact, be much more convenient for the builder or home owner to be able to connect the inlet structure at its top or side wall to the pipe or duct of the system. Also location of the outlet at the bottom of the chamber as taught in this U.S. patent specification will allow gravity to draw debris into the piping system that is too heavy for the vacuum system to carry. This will cause blockage in the piping resulting in expensive repair work.

U.S. Pat. No. 3,027,588 issued Apr. 3, 1962 to H. Bierstock describes a rather complex apparatus for picking up floor sweepings at a baseboard using a vacuum source or vacuum cleaner. This known apparatus includes an elongated nozzle having a lower lip portion that can be extended through a baseboard aperture adjacent the floor area. The nozzle is mounted at one end of a tube on which a piston is fixed. This piston is reciprocably mounted in a housing chamber. A controllable valve mechanism selectively leads the vacuum from the hose to the tube and nozzle or to either side of the piston to advance or retract the tube and the nozzle device. This known apparatus would be quite expensive to build and instal and would not appear to be practical for most home applications.

It is an object of the present invention to provide an improved inlet structure for a central vacuum system which can be used without the need for attaching a long hose and which is relatively inexpensive to manufacture and install and is easy to use.

It is a further object of the present invention to provide an inlet structure for a central vacuum system wherein the housing forming the vacuum inlet chamber is shaped in such a manner that dirt and debris will not easily become trapped somewhere in the chamber and will be readily passed through the chamber into the attached hose or pipe of the central vacuum system.

It is an additional object of the invention to provide an improved inlet structure for a central vacuum system which is relatively easy to install in a wall of a building or house and which can be readily connected to a pipe leading to a central vacuum source.

SUMMARY OP THE INVENTION

According to one aspect of the invention, a combined inlet structure and switching device for a central vacuum system includes an inlet housing having walls defining a vacuum inlet chamber and a front with a dirt receiving opening therein. An aperture is located in one wall of the housing and is adapted for connection to a pipe leading to a central vacuum source. A closure member is movable between a first position where the aperture is closed and a second position where the aperture is open. A foot operated actuator is connected to the housing and is provided to move the closure member between the first and second positions. There are also means for biasing the closure member towards the first position, this biasing mechanism operating when the actuator is pressed in one direction and not operating when the actuator has been moved to a position corresponding to the second position of the closure member. There is also a switch mechanism responsive to movement of the actuator for actuating a central vacuum source.

Preferably the biasing mechanism comprises a spring mounted on a wall of the housing. Also, the actuator is preferably pivotable about a pivot pin defining a substantially vertical pivot axis.

According to another aspect of the invention, an inlet structure for a central vacuum system comprises an inlet housing having top, bottom and side walls defining a vacuum inlet chamber. This housing has a front with an elongate, horizontally extending, dirt receiving opening and an aperture located in one of the walls other than the bottom wall. This aperture is adapted for connection to a pipe leading to a central vacuum source. The side wall is a curved wall extending from one side of the opening along a back of the housing, and to the opposite side of the opening. There are also means for fixedly mounting the inlet housing in the wall of a building or below a cabinet adjacent a floor. This inlet structure further includes a closure member movable between a first position where the aperture is closed and a second position where the aperture is open.

According to a further aspect of the invention, an inlet structure for a central vacuum system includes an inlet housing having walls defining a vacuum inlet chamber, these walls including top and side walls. The housing has a front side with a horizontally extending, dirt receiving opening. An aperture is formed in the top wall and is connectable to a pipe leading to a central vacuum source. There are also means for fixedly mounting the housing in a wall or other suitable fixed structure. A closure member is mounted in the housing and movable between closed and open positions wherein, in the closed position, air and dirt cannot generally be drawn out of the chamber through said aperture while in the open position, air and dirt can be drawn out of the chamber through the aperture.

Further features and advantages will become apparent from the following detailed description taken in conjunction with the drawings.

DETAILED DESCRIPTION OF PREFERRED EMBODIMENTS

Figure 1:
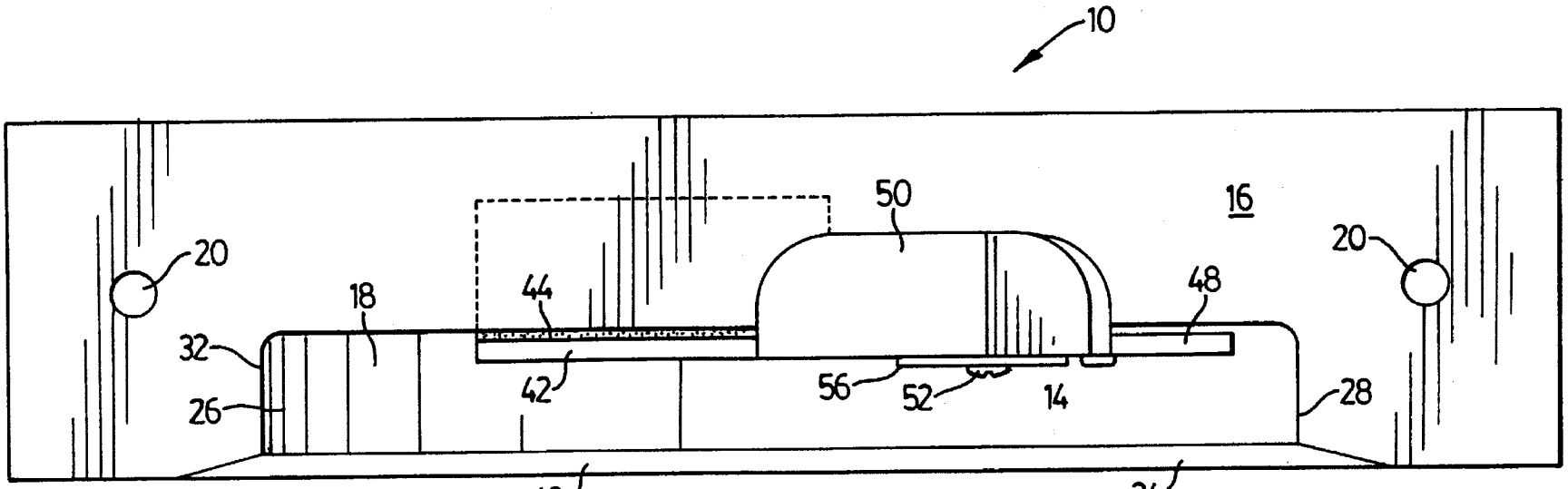
FIG. 1 is a front view of a combined vacuum inlet structure and switching device constructed in accordance with the invention.
Figure 2:
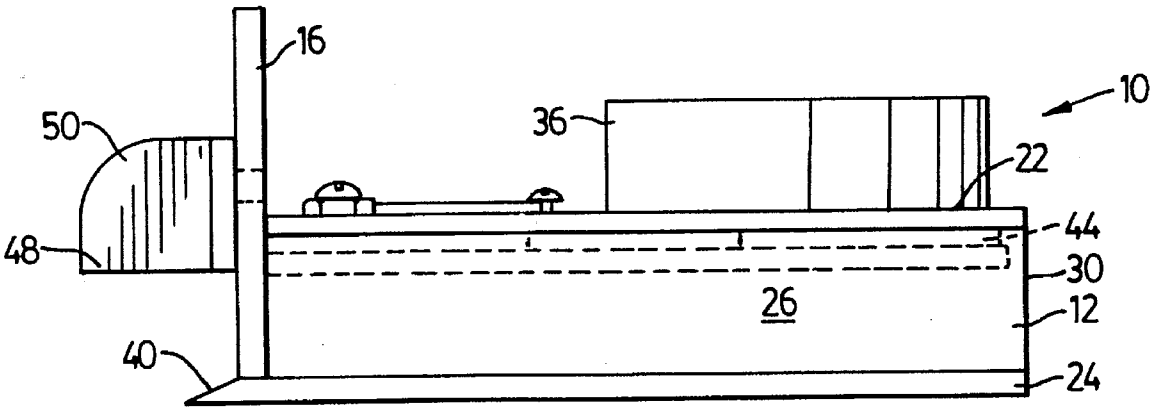
FIG. 2 is a right side view of the apparatus of FIG. 1.

A combined inlet structure and switching device 10 for a central vacuum system constructed in accordance with the invention is illustrated in FIGS. 1 and 2. The apparatus includes an inlet housing 12 having walls defining a vacuum inlet chamber 14. The housing has a front which can include a face plate 16 which, as illustrated, is generally rectangular. There is a dirt receiving opening 18 in the front of the housing and this opening is bounded on the top and on its sides by the face plate 16. Preferably the face plate is provided with at least two holes 20 located at opposite ends to receive fasteners such as screws (not shown).

The preferred form of housing includes a first, flat, horizontal top wall 22, a second, flat, horizontally extending bottom wall 24 and a third, curved side wall 26 that is curved substantially from one side 28 of the opening 18, along a back or side of the housing at 30 and to the opposite side 32 of the opening. The side of the housing at 30 is opposite the dirt receiving opening 18. Because of the configuration of the side wall, there are no corners or locations in the inlet chamber where dirt and debris can become trapped before they are able to exit through a circular aperture 34 located in the top of the housing. In addition, in the preferred embodiment, the height of the inlet chamber 14 is relatively small, for example, about ¾ inch and this helps to ensure that there is good cleaning suction in the inlet chamber. Surrounding the aperture 34 and extending upwardly therefrom is a cylindrical connecting flange 36 which, in one preferred embodiment, has a height of about ½ inch and an external diameter of 2 inches. The flange 36 provides means for connecting a pipe, such as the pipe 38 shown in FIG. 5, leading to a central vacuum source (not shown).

Preferably the bottom wall 24 is extended forwardly in front of the opening 18 and tapered so as to form a small ramp 40. The purpose of this ramp is to make it easier to sweep dirt and debris into the opening 18.

Figure 3:
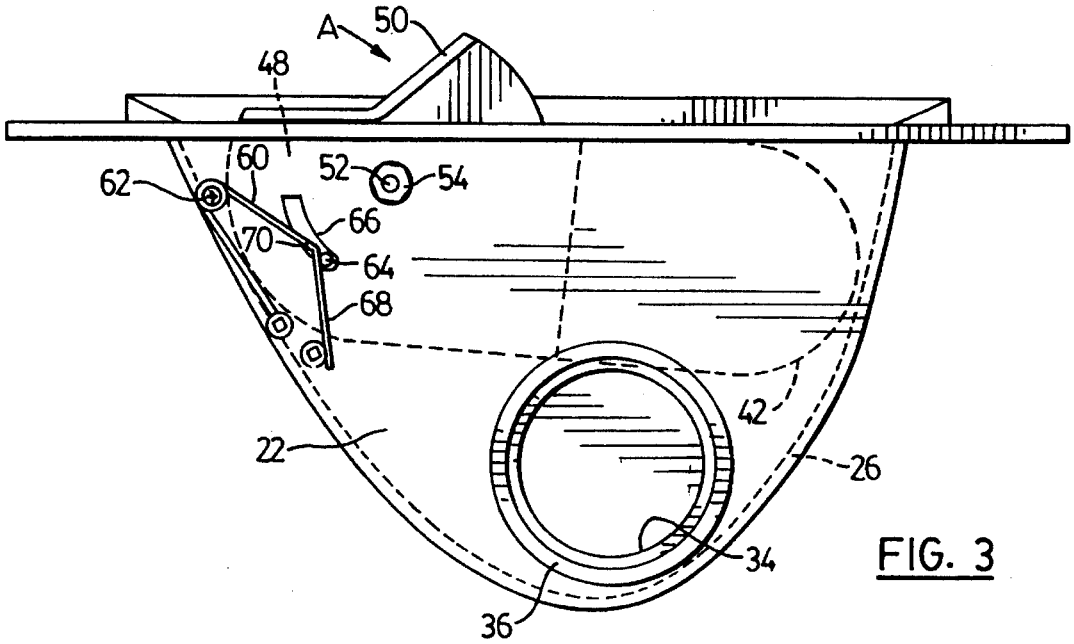
FIG. 3 is a top view of the apparatus of FIG. 1 showing a closure member in its open position in dashed lines.
Figure 4:
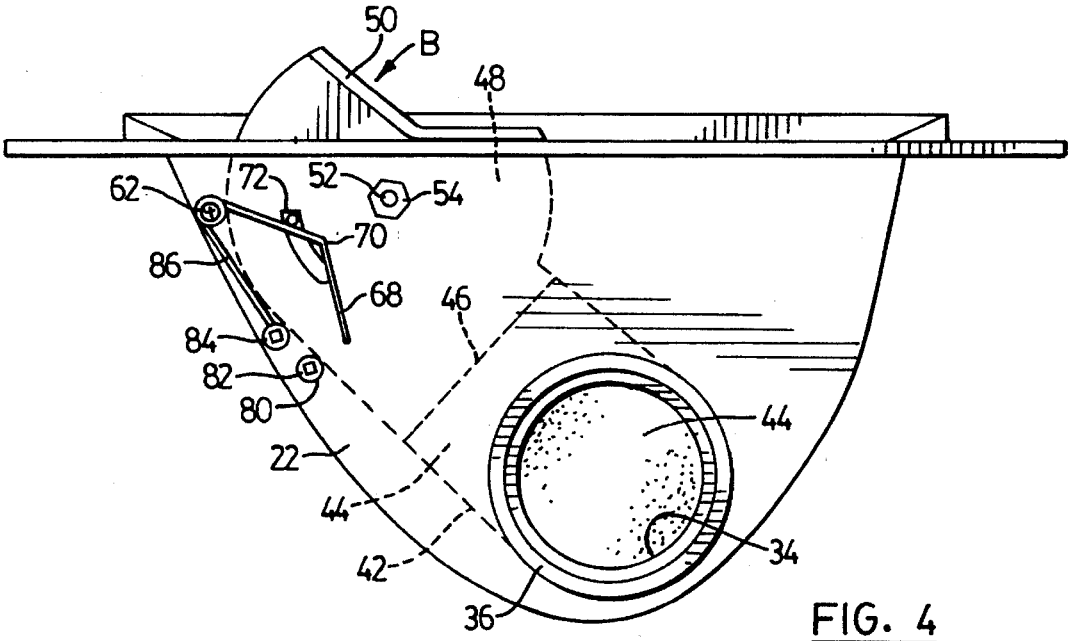
FIG. 4 is a top view similar to FIG. 3 but showing the closure member in its closed position, again in dashed lines.

The apparatus of the invention is equipped with a closure member 42 which is pivotable between a first position shown in FIG. 4 where the aperture 34 is closed and a second position shown in FIG. 3 where the aperture 34 is open. The preferred closure member comprises a flat, plate member that may be made of a suitably strong plastic or of metal. Preferably a seal member or gasket 44 is attached to the top of the closure member and helps to seal off the aperture 34 when the closure member is in the position shown in FIG. 4. The illustrated gasket or seal 44 is large enough to completely cover the aperture 34. In the illustrated embodiment, it is rounded at one end to conform to the shape of the closure member and squared at end 46. The gasket may be made of an inexpensive foam rubber or foam plastic material. The design and construction of the housing 12 and the closure member 42 reduce the possibility of blockage since obstructions in the chamber 14 have been eliminated. The pivoting closure member actually aids to dislodge anything that may become clogged in the chamber.

A foot operated actuator 48 is connected to the housing 12 and is provided for the purpose of moving the closure member 42 between the first and second positions. In the illustrated preferred embodiment, this actuator comprises a horizontal plastic or metal plate that projects partially beyond the front of the housing and is integrally connected to the closure member. In fact, the closure member 42 can be considered an integral extension of the actuator 48 in the preferred embodiment. The preferred actuator includes a generally vertical flange 50 that bends to form an obtuse angle in plan view. This flange is rigidly connected to the horizontal plate and is located in front of the housing where it can be readily pressed by the user's foot. The actuator 48 is a form of lever device which is able to pivot about a pivot pin which may comprise a short steel bolt 52 that extends through a hole in the top wall 22 and is secured in place by a nut 54. The pivot pin formed by the bolt extends perpendicular to the wall 22 in which the aperture 34 is located. If the plate of the actuator is made of plastic, the bolt 52 preferably extends through a steel washer 56 located on the bottom surface of the plate. Space is provided between the closure member and the bottom of the top wall 22 to ensure proper sliding operation of the closure member. For this purpose, in one embodiment of the invention, a suitable spacer (not shown) is located between the actuator plate and the top wall of the housing.

In an alternative version of the invention, if the closure member is made of plastic, the steel bolt 52 can be replaced by a plastic peg or pivot pin integrally formed with the closure member and extending through the top wall 22. A suitable screw is threaded into an axial hole formed in the plastic peg to secure it and the closure member in place.

Preferably there are means for biasing the closure member 42 towards the first, closed position and this biasing mechanism operates when the actuator 48 is pressed in the direction indicated by the arrow A in FIG. 3. The preferred illustrated biasing mechanism is a spring 60 which is mounted on the top wall 22 by means of a screw or bolt 62 and which has a first arm 86 and a second arm 68. The biasing mechanism further includes a post or pin 64 that extends upwardly from the actuator 48 and through a curved slot 66 in the top wall 22. This pin is engaged by the second arm 68 of the spring. In the illustrated spring, the arm 68 is bent at 70 to form an obtuse angle. By pressing on the actuator, one is able to force the pin or post 64 past the bend at 70 and, once this has occurred, the spring arm 68 will push the post to the end 72 of the slot as shown in FIG. 4.

In order to move the closure member to the open position, it is necessary for the user to press with his or her foot in the direction of the arrow B shown in FIG. 4. Sufficient pressure will cause the post 64 to push the spring arm 68 counterclockwise as seen in FIG. 4. Continued pressure will cause the closure member to move to the position illustrated in FIG. 3 and will cause the post 64 to be brought to the position shown in FIG. 3. It will be particularly noted that in the position of the post shown in FIG. 3, the spring does not act to move the post 64 and thus the closure member will remain in the open position until one pushes the actuator in the direction indicated by the arrow A. Thus, it is not necessary for the user to maintain foot or toe pressure on the actuator during continued operation of the apparatus. The user is thus free to sweep dirt and debris into the inlet structure.

Preferably the apparatus of the invention includes an electrical switch mechanism indicated generally at 80 which is responsive to movement of the actuator 48 for actuating a central vacuum source and, in particular, for closing an electrical circuit that will provide power to the central vacuum source. The switch mechanism 80 is mounted on the top wall 22.

In the illustrated embodiment, the switch mechanism includes two electrical terminals in the form of terminal screws 82 and 84 spaced from one another. The terminal screw 84 is connected to the first arm 86 of the spring. One end of the second spring arm 68 is moved into contact with the terminal screw 82 as shown in FIG. 3 when the closure member is moved to the second or open position. Electrical leads or wires 88 and 90 are connected to the screw terminals 82 and 84 and these leads are part of an electrical circuit that operates the central vacuum source in a manner known per se. The described switch mechanism 80 is in the "on" position for operation of the central vacuum source when the closure member is in its second or open position shown in FIG. 3 and is in the "off" position when the closure member is in its first position shown in FIG. 4.

Instead of the illustrated switch mechanism, it is also, of course, possible to use a standard, electrical switch that is secured to the top wall of the housing adjacent the spring. In this alternative version, the movable arm of the spring engages a movable switch arm located on one side of the switch itself. The leads or wires are then connected to terminals located on the switch.

Figure 5:
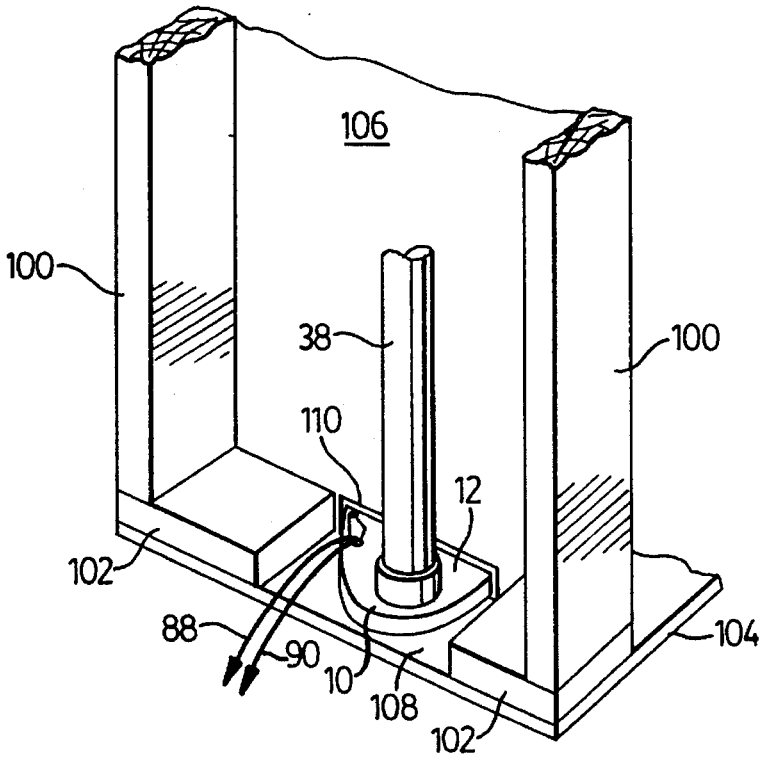
FIG. 5 is perspective view, taken from above and to the rear, showing how an apparatus constructed in accordance with the invention can be mounted in a wall made from 2 inch by 4 inch studs.

FIG. 5 illustrates how a preferred form of the apparatus of the invention can be mounted in the wall made with spaced apart 2 inch by 4 inch wooden studs 100. These studs extend upwardly from base plates 102 which can also be constructed from 2 inch by 4 inch studs. The baseplate members are secured to a floor structure which may comprise a plywood sheet 104 together with underlying support beams. The front or surface of the wall is formed by means of gypsum board or wallboard 106, only a portion of which is shown. In order to install the apparatus of the invention, a portion of the baseplate 102 is cut away to form a gap or opening 108. The length of this gap or opening need only be sufficient to accommodate the side-to-side width of the housing 12. A suitable elongate opening 110 can easily be cut in the wallboard 106 to permit insertion of the housing. The length and width of this opening should be smaller than that of the face plate 16 so that it will be covered thereby. Wallboard screws or nails (not shown) inserted through the holes 20 of the face plate can then be used to fixedly connect the face plate and the attached housing to the wall. Once the apparatus of the invention is fixed in place, a plastic pipe such as the pipe 38 shown in FIG. 5 can be attached to the top of the device 10 to draw air through the aperture 34. In the preferred illustrated embodiment, it is relatively easy to attach a pipe to the device since the aperture 34 is located on the top thereof. It may therefore not be necessary to cut an opening in the floor adjacent the device in order to connect same to the central vacuum system. Also, with the aperture 34 on top, only debris that is light enough to be carried by the vacuum system will be drawn into the piping, thus greatly reducing the possibility of blockages.

In order that the device 10 of the invention will fit easily in the wall structure made with 2 inch by 4 inch studs, the preferred embodiment of the device has a depth from its front side to the rear or back 30 of about 4 inches or less. Also, this preferred embodiment has a height from bottom wall 24 to the top wall 22 of about 1 inch (external dimension).

Figure 6:
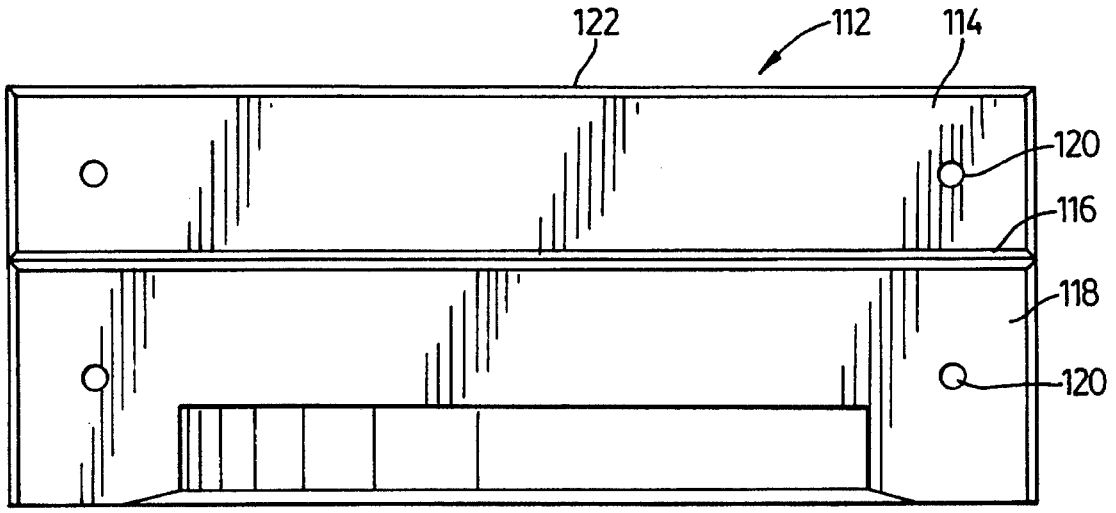
FIG. 6 is a front elevation of an alternative form of face plate for a vacuum inlet device.

FIG. 6 illustrates an alternative form of face plate that can be used with the vacuum cleaning inlet of the invention. In this embodiment, the face plate 112 has a break away upper portion 114 that can be removed from the main body of the inlet structure if it is not required to cover the hole formed in the building wall or cabinet. A breakable, horizontally extending V-groove 116 separates the upper portion from the lower portion 118. If desired, both the upper and lower portions can be provided with suitable screw holes 120. Preferably the peripheral edges along the top and sides are tapered as indicated at 122. With the use of this version of a face plate, installers of these units will have the option of using the full face plate, including the upper portion, thus allowing a larger access hole behind the face plate. If the installers prefer, they can snap off the upper portion in order to provide a low profile for installation along baseboards. In one preferred embodiment, the total height of the face plate of FIG. 6 is 3⅝ inch.

Figure 7:
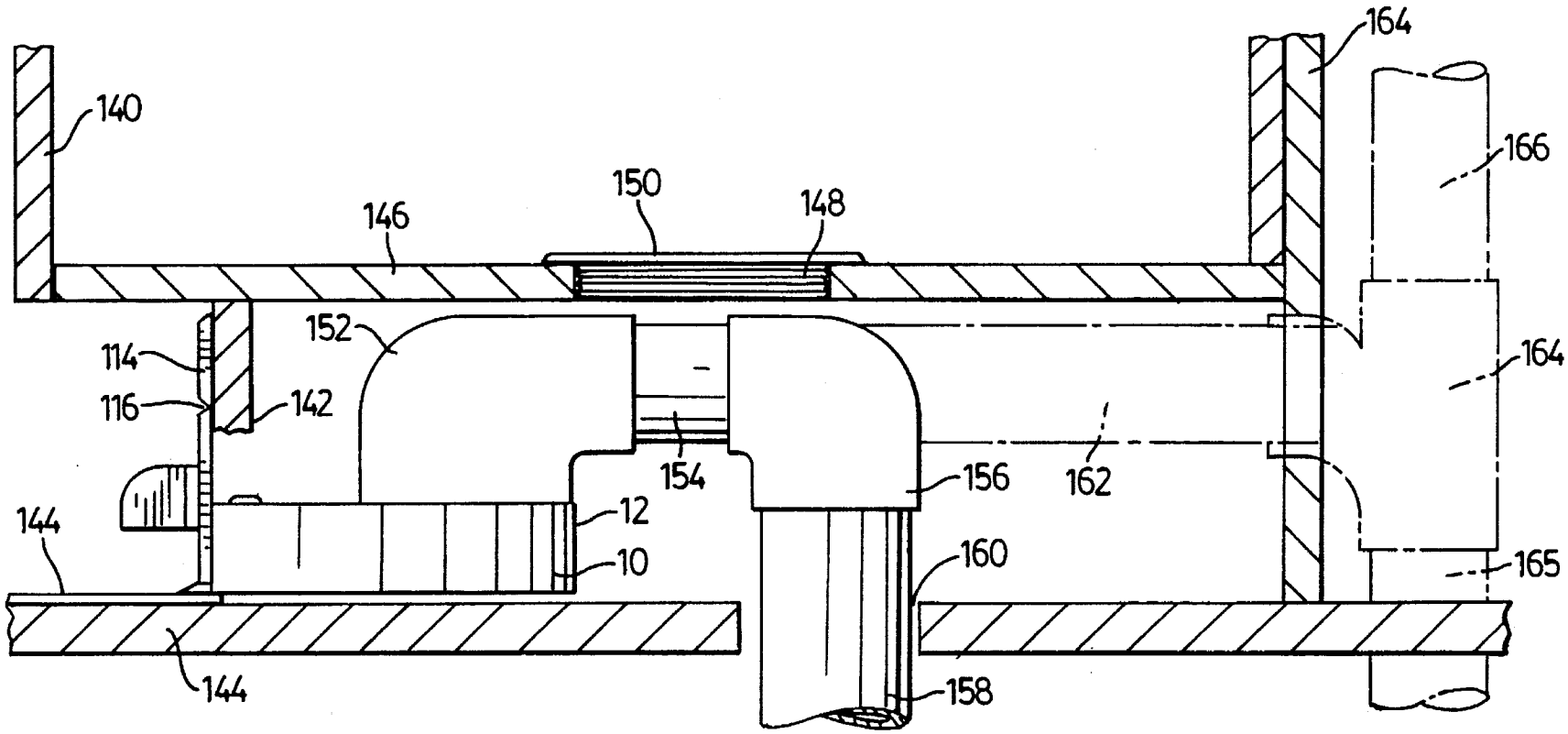
FIG. 7 is a side elevation, partly in cross-section, showing how the inlet structure of the invention can be mounted under a cabinet and hooked up to a central vacuum system.

FIG. 7 illustrates how the inlet device 10 of the invention can be installed under a cabinet 140, such as a kitchen cabinet. A suitable hole is cut in a kick board 142 of the cabinet. The inlet device 10 is inserted into this hole so that its front rests on smooth surface flooring 144 which could, for example, be tile or linoleum. This flooring rests on subfloor 144 which typically is made of plywood sheeting. The inlet device is located below the bottom 146 of the cabinet, which bottom may be provided with an access opening 148, if desired. Preferably this access opening would be covered with an access plate 150. A 90 degree pipe elbow 152 is connected to the aperture 34 in the top of the housing 12. As illustrated in solid lines, this elbow can be connected by a short, straight pipe 154 to another 90 degree pipe elbow 156 which in turn is connected to the central vacuum system by means of elongate pipe section 158 which may extend through a hole 160 in the subfloor. The pipe 158 could, for example, lead to a central vacuum source located in the basement of the building or house. In the alternative, as illustrated by dashed lines, the elbow 152 can be connected to a straight pipe section 162 that extends through a hole cut in the drywall 164 of the adjacent wall. Pipe section 162 can connect up to a pipe elbow or pipe joint 164 which in turn is connected to vertically extending vacuum pipe sections 165 and 166. It will be understood that these various pipe sections and elbows can be standard fittings and pipes. Also, the pipes 165 and 166 and the pipe fitting 164 are located in the wall cavity located between adjacent vertical studs.

It will be apparent to those skilled in this art that various modifications and changes can be made to the described combined inlet structure and switching device without departing from the spirit and scope of this invention. Accordingly, all such modifications and changes are intended to be included as part of this invention.

I therefore claim:

1. A combined inlet structure and switching device for a central vacuum system, comprising:

an inlet housing having walls defining a vacuum inlet chamber and a dirt receiving opening formed in said housing that permits dirt to enter said chamber;

an aperture located in one of said walls of said housing and adapted for connection to a pipe leading to a central vacuum source;

a closure member movable between a first position where said aperture is closed and a second position where said aperture is open;

a foot operated actuator connected to said closure member and said housing for moving said closure member between said first and second positions, said actuator including a pivot pin defining a pivot axis that is perpendicular to said one wall in which said aperture is located, and a lever device pivotable about said pivot axis and said pivot pin;

means for biasing said closure member towards said first position, said biasing means including a spring mounted on one of said walls, said spring forcing said closure member to said first position when said actuator is pressed in one direction and positioned not to bias said closure member when said actuator has been moved to a position corresponding to said second position of the closure member; and a switch mechanism responsive to movement of said actuator for actuating a central vacuum source.

2. A combined inlet structure and switching device according to claim 1 wherein said walls of the housing include a top wall, said aperture is located in said top wall of said housing, said closure member is an integral extension of said actuator and said closure member has means for sealing closed said aperture when the closure member is in said first position.

3. A combined inlet structure and switching device according to claim 2 wherein said actuator comprises a horizontal plate that projects partially beyond a front of said housing, and a generally vertical flange rigidly connected to said plate and located in front of said housing.

4. A combined inlet structure and switching device according to claim 1 wherein said housing has a back and one of said walls of said housing is a curved vertical sidewall extending from one side of said dirt receiving opening, around said back of said housing, and to the opposite side of said opening, and wherein said aperture is located adjacent said back of the housing.

5. A combined inlet structure and switching device according to claim 1 wherein the walls of said housing include horizontal top and bottom walls and at least one sidewall connecting the top and bottom walls, said aperture being located in said top wall.

6. A combined inlet structure and switching device according to claim 5 wherein said switch mechanism is mounted on said top wall along with said spring.

7. A combined inlet structure and switching device for a central vacuum system, comprising:

an inlet housing having walls defining a vacuum inlet chamber and a front with a dirt receiving opening therein;

an aperture located in one of said walls of said housing and adapted for connection to a pipe leading to a central vacuum source;

a closure member movable between a first position where said aperture is closed and a second position where said aperture is open;

a foot operated actuator connected to said closure member and said housing for moving said closure member between said first and second positions, said actuator including a pivot pin defining a substantially vertical pivot axis and a lever device pivotable about said pivot pin;

means for biasing said closure member towards said first position, said biasing means operating when said actuator is pressed in one direction and not operating when said actuator has been moved to a position corresponding to said second position of the closure member, said biasing means comprising a spring mounted on one of said walls;

a switch mechanism responsive to movement of said actuator for actuating a central vacuum source, said switch mechanism including two electrical terminals spaced from one another, one of said terminals being connected to said spring which has an end, and wherein said end of said spring is moved into contact with the other of said terminals when said closure member is moved to its said second position.

8. A combined inlet structure and switching device for a central vacuum system, comprising:

an inlet housing having walls defining a vacuum inlet chamber and a front with a dirt receiving opening therein, said housing having a slot formed in a top wall thereof;

an aperture located in one of said walls of said housing and adapted for connection to a pipe leading to a central vacuum source;

a closure member movable between a first position where said aperture is closed and a second position where said aperture is open;

a foot operated actuator connected to said closure member and said housing for moving said closure member between said first and second positions, said actuator including a pivot pin defining a substantially vertical pivot axis and a lever device pivotable about said pivot pin;

means for biasing said closure member towards said first position, said biasing means operating when said actuator is pressed in one direction and not operating when said actuator has been moved to a position corresponding to said second position of the closure member, said biasing means comprising a spring mounted on one of said walls and having an arm and further comprising a post extending upwardly from said actuator and through said slot, said post being engaged by said arm of said spring;

a switch mechanism responsive to movement of said actuator for actuating a central vacuum source.

9. A combined inlet structure and switching device according to claim 8 wherein said switch mechanism includes two electrical terminals spaced from one another, one of said terminals being connected to said spring which has an end, and wherein said end of said spring is moved into contact with the other of said terminals when said closure member is moved to its second position.

10. An inlet structure for a central vacuum system comprising:

an inlet housing having walls forming sides of said housing and defining a vacuum inlet chamber, said walls including first and second generally parallel walls and a third wall extending between said first and second walls, said housing having an elongate horizontally extending, dirt receiving opening, and an aperture located in one of said first and second walls, said aperture being adapted for connection to a pipe leading to a central vacuum source, said third wall being a curved wall that is curved substantially from one side of said opening, along one side of said housing which is opposite said dirt receiving opening, and to the opposite side of said opening;

means for fixedly mounting said inlet housing to a wall of a building or to a cabinet adjacent a floor; and a closure member connected to said housing and movable between a first position where said aperture is closed and a second position where said aperture is open.

11. An inlet structure according to claim 10 including an electrical switch movable between off and on positions and mounted on said housing, said switch being connectible by wiring to said central vacuum source, said switch being in the on position for operation of said central vacuum source when said closure member is in said second position and being in the off position when said closure member is in said first position.

12. An inlet structure according to claim 10 including a foot operated lever device for pivoting said closure member between said first and second positions, wherein said lever device projects from the housing and is connected to said closure member.

13. An inlet structure according to claim 12 wherein said mounting means includes a flat face plate having fastener holes formed therein, said face plate being fixed on a front of the housing.

14. An inlet structure according to claim 13 wherein said face plate has a breakaway upper portion that can be removed from the inlet structure if it is not required to cover a hole formed in said building wall or cabinet.

15. An inlet structure for a central vacuum system comprising:

an inlet housing having walls defining a vacuum inlet chamber, said walls including said walls and a generally horizontal top wall, said housing having a front side with a horizontally extending, dirt receiving opening, and an aperture in said top wall, said aperture being connectible to a generally vertical pipe leading to a central vacuum source;

means for fixedly mounting said housing in a wall or other suitable fixed structure; and a closure member mounted in said housing and movable between closed and open positions relative to said aperture, a lever device having an open and closed position, said lever device connected to said closure member to positively move said closure member selectively to said open or closed position, and a spring biasing said lever device and closure member to the closed position when said lever device is moved to the closed position; wherein in said closed position of said closure member air and dirt cannot generally be drawn out of said chamber through said aperture, while in said open position of said closure member, air and dirt can be drawn out of said chamber through said aperture.

16. An inlet structure according to claim 15 including a switch mechanism movable between off and on positions and mounted on said housing, said switch mechanism providing means for locally controlling the operation of said central vacuum source, said switch being moved to the on position for operation of said central vacuum source when said closure member is in said open position and being in the off position when the closure member is in the closed position.

17. An inlet structure according to claim 16 wherein said switch mechanism includes two switch terminals cooperating with said spring, said spring being connected to one of said terminals and having an arm movable into engagement with the other of said terminals.

18. An inlet structure according to claim 16 wherein said mounting means comprises a face plate at the front side of said housing, a dirt receiving opening being formed in said face plate, and wherein fastener holes are formed in said face plate for connecting said face plate to an adjacent wall or other fixed structure.

19. An inlet structure according to claim 15 wherein said housing has a depth from said front side to a rear side thereof of about 4 inches or less and has a height from a bottom wall of the housing to said top wall of about 1 inch.

* * * * *

UNITED STATES PATENT AND TRADEMARK OFFICE

CERTIFICATE OF CORRECTION

PATENT NO. : 5,504,967

DATED : April 9, 1996

INVENTOR(S) : Bernard J. Graham

It is certified that error appears in the above-indentified patent and that said Letters Patent is hereby corrected as shown below:

Claim 15, column 10, line 14, after "including" delete "said" and substitute therefor --side--.

Signed and Sealed this

Twenty-fifth Day of June, 1996

*Attest:*

Bruce Lehman

BRUCE LEHMAN

*Attesting Officer*

*Commissioner of Patents and Trademarks*